US008567501B2

(12) United States Patent
Zimmerman et al.

(10) Patent No.: US 8,567,501 B2
(45) Date of Patent: Oct. 29, 2013

(54) SYSTEM AND METHOD FOR STIMULATING MULTIPLE PRODUCTION ZONES IN A WELLBORE WITH A TUBING DEPLOYED BALL SEAT

(75) Inventors: Mark Zimmerman, Cypress, TX (US); Blake Cox, Willis, TX (US); John Hughes, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 456 days.

(21) Appl. No.: 12/887,860

(22) Filed: Sep. 22, 2010

(65) Prior Publication Data

US 2012/0067583 A1 Mar. 22, 2012

(51) Int. Cl.
*E21B 43/16* (2006.01)

(52) U.S. Cl.
USPC ..... 166/307; 166/318; 166/308.1; 166/177.5

(58) Field of Classification Search
USPC ..... 166/308.1, 318, 177.5, 291, 307, 285, 166/306
See application file for complete search history.

(56) References Cited

U.S. PATENT DOCUMENTS

2008/0210429 A1 * 9/2008 McMillin et al. ..... 166/313

* cited by examiner

*Primary Examiner* — Yong-Suk (Philip) Ro
(74) *Attorney, Agent, or Firm* — Parsons Behle & Latimer

(57) ABSTRACT

A system and method for selectively stimulating a plurality of producing zones in a wellbore in oil and gas wells. The system includes a plurality of modules connected in a string that may be selectively actuated to stimulate a producing zone. Each module may be adapted to engage a tubing run ball seat. After installation of the string within the wellbore, a ball seat may be run into the well and positioned to selectively engage a desired module. The ball seat may be used to open a sleeve of the module permitting the stimulation of the producing zone. After stimulation of the producing zone, the ball seat may be removed from the wellbore rather than needing to drill out the ball seat. The sleeve may include a profile adapted to engage a shifting tool permitting the selective closure of the sleeve after stimulation of the producing zone.

31 Claims, 6 Drawing Sheets

SYSTEM AND METHOD FOR STIMULATING MULTIPLE PRODUCTION ZONES IN A WELLBORE WITH A TUBING DEPLOYED BALL SEAT

BACKGROUND

1. Field of the Disclosure

The present disclosure relates generally to a downhole tool for use in oil and gas wells, and more specifically, to a tubing deployed ball seat and the method for fracturing a well formation using the tubing deployed ball seat.

2. Description of the Related Art

If a hydrocarbon well is not adequately producing, it may be necessary to perform a completion process on the formation to stimulate a production zone, such as hydraulic fracturing the production zone. Hydraulic fracturing is typically employed to create additional passageways or otherwise increase the permeability of underground rock formations to facilitate flow through the formation to a producing well. Typically, fracturing may be accomplished by injecting a fluid containing sand or other proppant under sufficient pressure to create fractures in the rock. Fracturing the formation may be used to accomplish by a number of different methods. Methods that permit the fracturing of multiple production zones within a wellbore during a single trip into the wellbore may be beneficial to minimize the completion time and/or costs.

For example, U.S. Pat. No. 6,006,838 entitled "Apparatus and Method for Stimulating Multiple Production Zones in a Wellbore," which in its entirety is incorporated by reference herein, discloses a fracturing string, or work string, that includes a plurality of modules with sliding sleeves that may be used to stimulate multiple production zones in a wellbore in a single trip into the wellbore. U.S. Pat. No. 7,681,645 entitled "System and Method for Stimulating Multiple Production Zones in a Wellbore," which in its entirety is incorporated by referenced herein, discloses positioning the fracturing string disclosed in U.S. Pat. No. 6,006,838 within a desired location within a wellbore and then cementing the fracturing string in place using an acid soluble cement. Cement is pumped down the string, out the end of the string, and up and around the outside of the diameter of the string. The cement is allowed to cure, thus cementing the fracturing string at the desired location. Sliding sleeves on each module within the fracturing string may be selectively opened to fracture desired zones within the wellbore, as detailed below.

A wiper plug may be pumped down the string after the cement, and preferably before the displacement fluid, to wipe any residual cement from the inner diameter of the string. The wiper plug also helps to separate the acid soluble cement from acid pumped down the string after the wiper plug. At least one wiper ball may also be pumped down the string after the wiper plug. The wiper ball may be pumped down the string within a spacer fluid to help protect the wiper ball from being damaged by the acid solution. The wiper ball may help to remove any residual cement from the internal bores of the modules allowing the sliding sleeves to slide when actuated. The acid pumped within the string also prevents any residual cement from curing inside of the string.

After the cement has cured around the outside of the string, fluid is pumped down the string. The hydraulic pressure of the pumped fluid moves the sliding sleeve of the lowermost module to an open position. The acid within the string breaks down the cement that has formed outside of the fracturing string after the sliding sleeve of the module is opened. Hydraulic pressure may then fracture the formation adjacent the opened module. A proppant containing slurry may follow behind the acid to extend and support the fracture. Once the formation at the lowermost module has been fractured, an appropriately sized ball may be dropped down the string to land in the ball seat of the next lowermost module. The seated ball prevents flow to the first module and the pressure within the string will build until the sliding sleeve of the second module moves to the open position. The acid may then break down the cement adjacent to the second module outside of the fracturing string and hydraulic pressure may fracture the formation at this location. The process is repeated until the cement adjacent each module has been broken down and each of the specified zones have been fractured.

The assembly disclosed in U.S. Pat. No. 6,006,838 is used for selectively stimulating a wellbore without the use of a general packer, such as an openhole inflatable packer. This assembly is especially suited to perform a combination of matrix acidizing jobs and near wellbore erosion jobs at a number of producing zones in the wellbore in a single trip.

Prior to the assembly disclosed in U.S. Pat. No. 6,006,838 and U.S. Pat. No. 7,681,645, operators who were interested in stimulating multiple producing zones in an openhole wellbore could stimulate the zones one zone at a time by using a work string and a packer. Such a method and assembly required the operator to set an inflatable packer (or other similar apparatus) above each zone of interest to be stimulated and then, following the stimulation job, to release the packer (or packers) and trip the packer assembly to a new location where it would be reset for the next stimulation job. This procedure would be repeated for each desired zone of interest. However, because of the tripping time and the difficulty in setting and maintaining the seal in inflatable packers in openhole wellbores, such a method was both time consuming and relatively unreliable. Furthermore, openhole inflatable packers (or other similar devices) are expensive to rent or to purchase. As a result of the relative unreliability and cost of using openhole inflatable packers, such assemblies prove to be uneconomical in marginal fields such as fields in the Permian Basin region of West Texas and Eastern New Mexico.

The assembly disclosed in U.S. Pat. No. 6,006,838 and U.S. Pat. No. 7,681,645 does not require an inflatable packer and is very economical to build and maintain. Thus, an operator can use the assembly for a small incremental cost over what it costs to perform an acid job and receives the benefits of not only a matrix acidizing treatment, but can also enhance the flow in the near wellbore region by eroding away near wellbore skin damage. The assembly also allows an operator to accurately position an assembly in a wellbore to ensure that the producing zones of interest are stimulated.

The present invention is an improvement to the assembly disclosed in U.S. Pat. No. 6,006,838 and U.S. Pat. No. 7,681,645 for selectively stimulating a wellbore without the use a packer. Specifically, the disclosed ball drop apparatus and method provides more flexibility in the fracturing of the wellbore formation. The tubing run ball seat assembly of the present disclosure permits the stimulation of production zones in any practically any order after opening the hydro port and the toe of the string.

Another potential advantage of the present disclosure is that a larger number of production zones may be treated with a single trip of a work string into the wellbore. Due to the use of removable ball seat assemblies of the present disclosure, over fifty stages or modules may be treated with a single trip of a four and a half (4½) inch fracturing string.

Another potential advantage of the present disclosure is that the ball seat assemblies may be retrieved from the work string. After removal, the ball seat assemblies may be serviced and potentially reused on additional work strings. Further, the removal of the ball seat assembly from the work string permits the closure of the fracturing sleeve, if needed.

The present disclosure is directed to overcoming, or at least reducing the effects of, one or more of the issues set forth above.

SUMMARY OF THE DISCLOSURE

The following presents a summary of the disclosure in order to provide an understanding of some aspects disclosed herein. This summary is not an exhaustive overview, and it is not intended to identify key or critical elements of the disclosure or to delineate the scope of the invention as set forth in the appended claims.

One embodiment of the present disclosure is an apparatus for selectively stimulating a formation within a wellbore. The apparatus comprises a housing having a fracture port that permits fluid communication between its inner bore and the exterior of the housing. A fracture sleeve of the housing is movable between an open position that permits the fluid communication between the inner bore and the exterior through the fracture port and a closed position that prevents fluid communication through the fracture port. The housing is connected to a fracture string. The apparatus also comprises a ball seat assembly that is adapted to selectively engage the housing. The ball seat is adapted to sealingly engage a ball having a predetermined diameter. A key that is adapted to selectively mate with a profile on the fracture sleeve is connected to the ball set. The apparatus includes a lock sleeve that is connected to the ball seat. The lock sleeve is movable from an initial unlocked position to a locked position. The lock sleeve may be biased to move to the locked position. While in the locked position, the lock sleeve is adapted to selectively retain the key in a mated position with the profile on the fracture sleeve.

The ball seat assembly may be adapted to be installed onto a housing of a fracturing string that is already positioned within a wellbore. The apparatus may include a spring that biases the lock sleeve to its locked position. The apparatus may further comprise a collet finger that is adapted to selectively engage a first recess in the housing when the fracture sleeve is in its closed position and a second recess in the housing when the fracture sleeve is in its open position. The apparatus may further comprise a shearable device that selectively retains the fracture sleeve in its closed position. The shearable device may be adapted to shear and release the fracture sleeve from the closed position upon the application of a predetermined pressure differential.

The apparatus may further comprise a leaf spring connected to the ball seat that is adapted to move the key to an expanded position that engages the profile on the fracture sleeve. The lock sleeve of the apparatus may include an exterior profile that is adapted to engage a profile on a running tool. The exterior profile on the lock sleeve may be adapted to engage a lock dog on a running tool. The exterior profile on the lock sleeve may also be adapted to engage a profile on a retrieval tool. The running tool may be adapted to position a ball seat assembly into a wellbore to selectively engage a housing of a fracture string when the fracture sleeve of the housing is in the closed position. The retrieval tool may be adapted to release the ball seat assembly from the housing of the fracture string when the fracture sleeve is in the open position. The shifting tool may be adapted to engage the profile on the fracture sleeve and selectively move the fracture sleeve to the closed position after removing the ball seat assembly from the housing.

One embodiment of the present disclosure is a method of selectively fracturing and/or treating multiple zones within a wellbore with a single trip into the wellbore with a fracture string. The method comprises running at least a first ball seat assembly into the wellbore and selectively connecting the first ball seat assembly onto a first housing on the fracture string within the wellbore. The first ball seat assembly is run into the wellbore after the fracture string has already been positioned into the wellbore. The method includes running at least a second ball seat assembly into the wellbore after running in the first ball seat assembly and selectively connecting the second ball seat assembly to a second housing on the fracture string. The method further comprises applying pressure to the fracturing string to open a hydro port sub on the fracture string and inserting a first ball into the fracture string. The first ball is adapted to seat on the first ball seat and prevent fluid flow within the fracture string past the first ball seat. The method comprises pumping fluid down the fracture string to create a pressure differential that moves a sleeve within the first housing opening a first fracture port and fracturing and/or treating the wellbore formation adjacent the first fracture port. The method comprises inserting a second ball in the fracture string that is adapted to seat on the second ball seat and prevent fluid flow within the fracture string past the second ball seat. The method includes pumping fluid down the fracture string to create a pressure differential to move a sleeve within the second housing opening a second fracture port and fracturing and/or treating the formation adjacent to the second fracture port.

The method may further comprise running a third ball seat assembly into the wellbore and selectively connecting the third ball seat assembly onto a third housing on the fracture string within the wellbore. The third ball seat assembly may be run into the wellbore after the fracturing and/or treating of the formation adjacent to the second fracture port. The method may further comprise inserting a third ball into the fracture string. The third ball being adapted to seat on the third ball seat and prevent fluid flow within the fracture string past the third ball seat. The third ball may have the same diameter as the first ball inserted into the fracture string. The method may include pumping fluid down the fracture string, after insertion of the third ball, to create a pressure differential to move a sleeve within the third housing to open a third fracture port and fracturing and/or treating the formation adjacent to the third fracture port.

The method may include removing the first ball seat assembly, the second ball seat assembly, and/or the third ball seat assembly from the wellbore. The method may further comprise moving at least one of the fracture sleeves to close one of the fracture ports. A running tool may be used to run the first ball seat assembly into the wellbore. The method may further comprise moving the running tool downhole past the first housing and pulling the running tool uphole past the first housing engaging a first profile on the first ball seat assembly with a profile on the sleeve of the housing to selectively retain the first ball seat assembly to the sleeve of the housing.

One embodiment of the present disclosure is a method for completing a hydrocarbon producing wellhole comprising running a ball seat assembly into a work string within a wellbore and selectively connecting the ball seat assembly to a portion of the work string that include a port and a sleeve moveable between a closed position and an open position. In the closed position, the sleeve prevents fluid communication through the port and permits fluid communication through the port when in the open position. The method comprises inserting a ball into the work string that is adapted to seat on the ball seat assembly preventing fluid flow through the work string past the ball seat. The method further comprises applying a pressure differential within the work string to move the sleeve to the open position and treating a well formation through the open port.

The method may comprise running a second ball seat assembly into the work string and selectively connecting the second ball seat assembly to a second portion of the work string having a second port and a second movable sleeve that is movable between an open position and a closed position. The method may comprise inserting a second ball into the work string adapted to seat on the second ball seat assembly preventing fluid flow through the work string past the second ball seat assembly, applying a pressure differential within the work string to move the second sleeve to its open position, and treating a well formation through the open second port. The first ball and the second ball may be the same size.

One embodiment of the present disclosure is a system for treating multiple zones of a wellbore with a single trip of a work string. The system comprises a work string positioned within the wellbore and a first plurality of housings locating along the work string. Each housing of the first plurality of housings having a port and a sleeve movable to open and close the port. The system further comprises a first plurality of ball seat assemblies that may be run into the work string position in the wellbore. Each of the first plurality of ball seat assemblies adapted to selectively mate with a housing of the first plurality of housings. The system further comprises a first plurality of balls each being a different size that may be inserted individually into the work string. Each ball of the first plurality of balls is adapted to be retained by a corresponding ball seat assembly within the first plurality of ball seat assemblies, wherein a pressure differential may be applied to the work string to move the sleeve and open the port of each housing of the first plurality of housings.

The system further comprises a second plurality of ball seat assemblies that may be run into the work string positioned in the wellbore. Each of the second plurality of ball seat assemblies is adapted to selectively mate with a housing of the second plurality of housings. The system further comprises a second plurality of balls each being a different size that may be inserted individually into the work string. Each ball of the second plurality of balls is adapted to be retained by a corresponding ball seat assembly within the second plurality of ball seat assemblies, wherein a pressure differential may be applied to the work string to move the sleeve and open the port of each housing of the second plurality of housings.

The different sizes of the first plurality of balls may be identical to the different sizes of the second plurality of balls. The system may further comprise a third plurality of housings located along the work string and a third plurality of ball seat assemblies that may be run into the work string positioned in the wellbore. Each of the third plurality of ball seat assemblies is adapted to selectively mate with a housing of the third plurality of housings. The system further comprises a third plurality of balls each being a different size that may be inserted individually into the work string. Each ball of the third plurality of balls is adapted to be retained by a corresponding ball seat assembly within the third plurality of ball seat assemblies, wherein a pressure differential may be applied to the work string to move the sleeve and open the port of each housing of the third plurality of housings. The different sizes of the first plurality of balls may be identical to the different sizes of the third plurality of balls.

Figure 1:
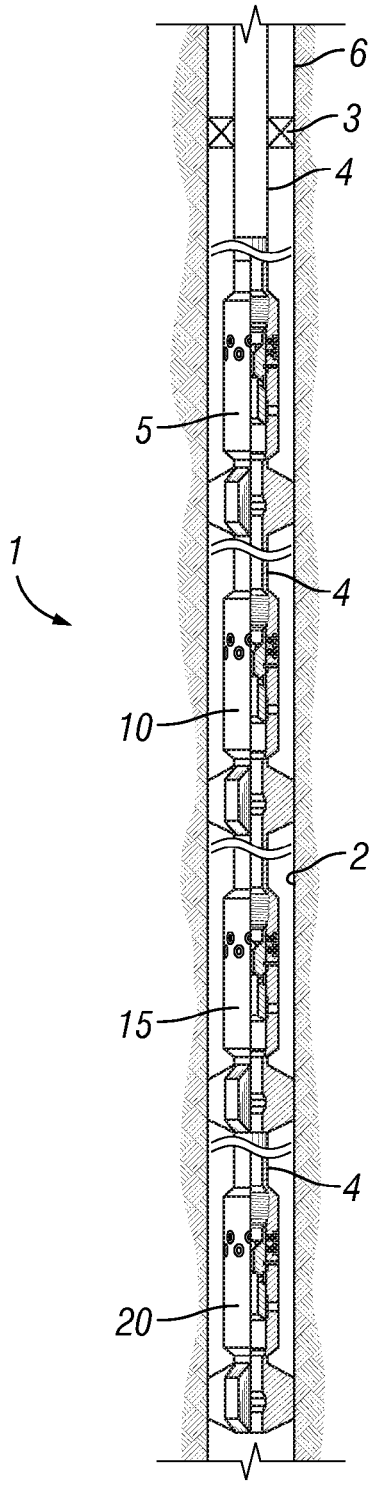
FIG. 1 (Prior Art)
FIG. 1 illustrates a partial cutaway of an assembly for selectively stimulating a plurality of producing zones in an openhole wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

FIGS. 1-6 illustrate the fracturing string and assembly disclosed in U.S. Pat. No. 6,006,838 and U.S. Pat. No. 7,681,645, which is discussed herein to detail the process of fracturing multiple production zones within a wellbore. The present disclosure is an improved device and method for fracturing multiple production zones within a wellbore.

Figure 2:
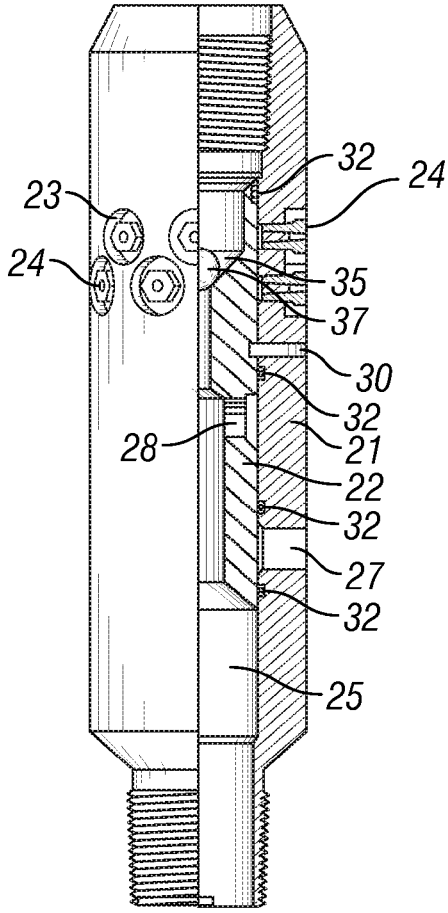
FIG. 2 (Prior Art)
FIG. 2 shows a partial cutaway of one embodiment of a module used in the assembly shown in FIG. 1.
Figure 3:
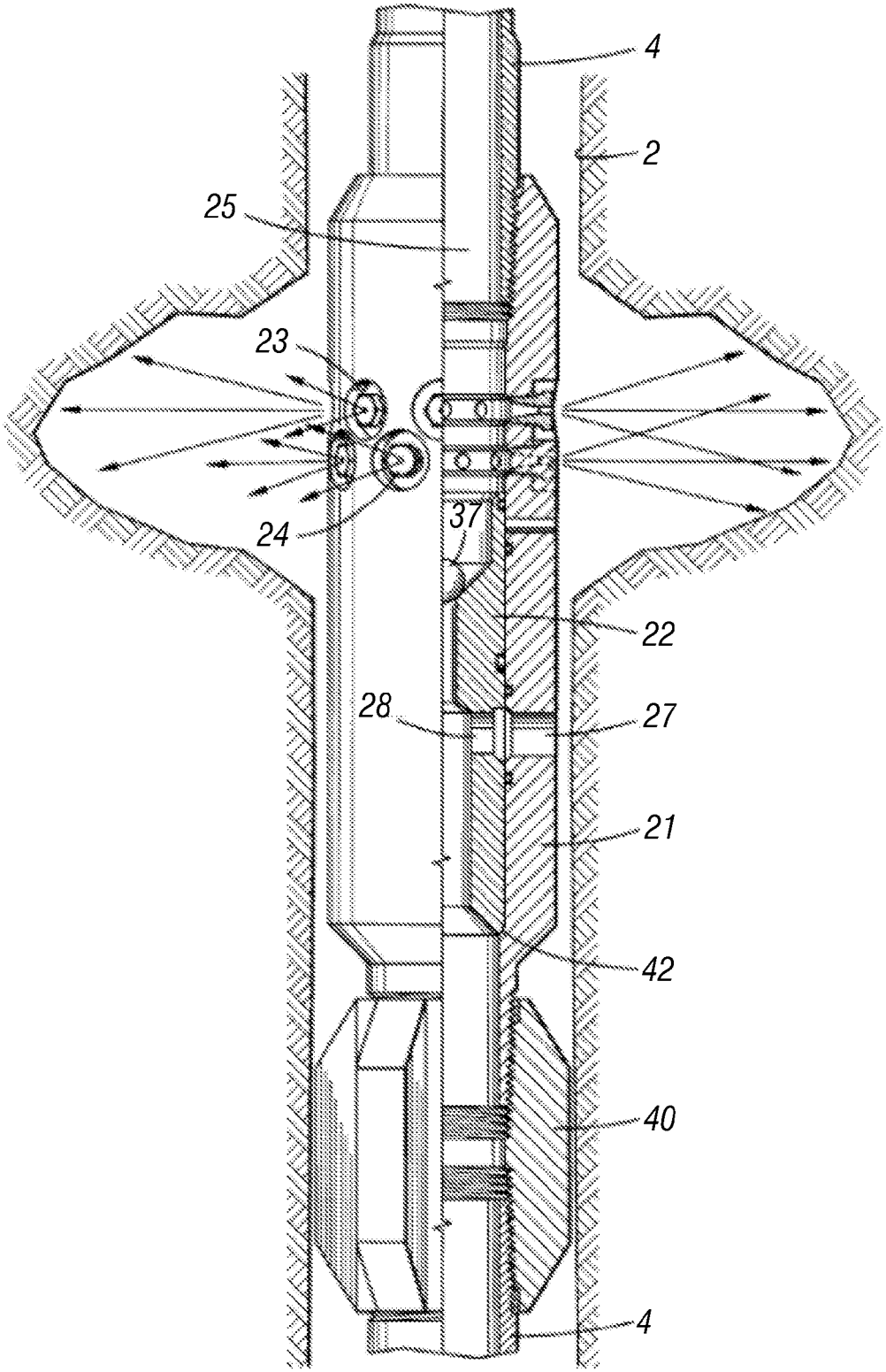
FIG. 3 (Prior Art)
FIG. 3 illustrates the module of FIG. 2 with the shifting sleeve in the open position.

Referring to FIGS. 1-3, an embodiment of an assembly for selectively stimulating producing zones in a subterranean wellbore will now be described. The assembly 1 includes a plurality of modules or stages which are attached to a tailpipe 4 (shown in cutaway to reflect the longitudinal distance between the modules). The assembly in FIG. 1 includes modules 5, 10, 15 and 20. Tailpipe 4 is suspended from service packer 3 which is set inside casing 6, above the openhole wellbore 2. The service packer may be, for example, a compression packer, such as an SD-1 or MR1220 packer available from BJ Services Company. A work string of tubing, drillpipe or the like extends from packer 3 to the surface. The tailpipe string, being suspended from packer 3, extends into the openhole beneath the casing shoe. In an embodiment, modules 5, 10, 15 and 20 are spaced in the tailpipe string at predetermined locations so that an individual module is adjacent a producing zone desired to be stimulated. The tailpipe string may be comprised of tubing, drillpipe or the like and the length of tailpipe between adjacent modules will depend on the distance between the producing zones or targets of interest. Alternatively, it will be understood that the packer could be reset at different locations in the casing to locate one or more modules of the assembly adjacent one or more producing zones or targets of interest. In other words, the entire assembly can be repositioned within the wellbore to more accurately position some of the modules without tripping the assembly out of the wellbore.

As shown in FIG. 2, each module comprises a generally tubular-shaped housing 21 which includes a threaded upper and lower end for connecting the module to the tailpipe string. Central passageway 25 extends longitudinally through housing 21. Each module includes shifting sleeve 22 which is adapted for longitudinal movement along the inner wall of housing 21. Shifting sleeve 22 includes one or more radially extending ports 28 which are arranged about the circumference of the sleeve. Housing 21 also includes one or more radially extending ports 27 circumferentially spaced about the housing. The number of ports 28 in shifting sleeve 22 will correspond to the number of flow ports 27 in housing 21. Shifting sleeve 22 includes a landing seat or ball seat 35. The size of ball seat 35 will differ from module to module in the assembly, with the lowermost module 20 having the smallest ball seat and the uppermost module 5 having the largest ball seat.

Housing 21 may include a plurality of nozzle holes 23 which extend radially through the wall of housing 21 for receiving interchangeable jet nozzles 24. Jet nozzles 24 may be held in nozzle holes 23 by any suitable means such as mating threads, snap rings, welding or the like. Jet nozzles may come in a wide variety of orifice sizes. The size of the nozzle orifice may be predetermined to achieve the desired fluid hydraulics for a particular acid job. Some of the nozzles may be selectively blanked off to achieve the optimum flow rates and pressure drops across the remaining nozzles. In general, the number and size of the working jet nozzles will reflect the desired kinetic energy to be used in treating a given producing zone. The nozzle may be adapted to be a fracture port used in a stimulation process.

Shifting sleeve 22 is initially attached to housing 21 in the closed position by one or more shear screws 30 so that the shifting sleeve straddles jet holes 23, jet nozzles 24 and fluid flow ports 27. Seals 32 seal the annular space between shifting sleeve 22 and housing 21. Elastomeric seals 32 may be o-ring seals, molded seals or other commonly used oilfield seals. The remaining components of the module may be manufactured from common oilfield materials, including various steel alloys.

As shown in FIG. 3, centralizing coupling 40 may be attached to the lowermost end of housing 21. Centralizing coupling 40 not only connects the module to lower tailpipe 4 but also centralizes the module and assembly in the wellbore. Centralizing coupling 40 includes a plurality of centralizing ribs, with adjacent fluid flow passageways therebetween.

As shown in FIG. 1, an assembly for selectively stimulating a plurality of intervals or targets in a wellbore includes a plurality of modules assembled in a tailpipe string. By varying the length of tailpipe between modules, an operator can space the individual modules so that a module is adjacent each desired producing interval or target to be stimulated. The selectivity is provided by varying the size of the landing seat 35 on shifting sleeve 22. The lowermost module 20 will have the smallest ball seat 35, i.e., the smallest internal diameter of any of the modules, for catching the smallest ball. The next to last module in the assembly will have a slightly larger ball seat 35 and so on until the uppermost module, which will have the largest ball seat, i.e., the largest internal diameter of any of the modules. Thus, the actuating balls for the assembly will increase in diameter as the fracturing process proceeds from the lowermost module to the uppermost module.

In operation, the assembly of FIG. 1 is run into the wellbore suspended from packer 3. The packer is set in the production casing near the casing shoe at a predetermined location. Tailpipe 4 and modules 5, 10, 15 and 20 extend beneath the casing shoe into the open hole. The modules are spaced apart in the tailpipe string so that each particular module will be adjacent to a producing zone that the operator desires to stimulate. The stimulation treatment begins with the lowermost zone and works its way up the wellbore. An appropriate sized ball is dropped or pumped down the work string and into the assembly until it lands on seat 35 of shifting sleeve 22 in the lowermost module 20. Pressure is increased inside the work string and assembly until the force acting across the actuating ball and ball seat exceeds the shear value for shear screw 30. Once shear screw 30 is sheared, shifting sleeve 22 is shifted downward to the treating position against shoulder 42 of housing 21. As shown in FIG. 3, when the shifting sleeve is in the open or treating position, jet nozzles 24 are in communication with central passageway 25. Once landed, ball 37 prevents acid from passing out the bottom of the assembly. Acid is then pumped at a desired rate through jet nozzles 24 to acidize and erode the wellbore adjacent the jet nozzles. The kinetic energy created by pumping the acid through the jet nozzles mechanically erodes away the wellbore formation adjacent the nozzles as illustrated in FIG. 3. The same assembly may be used for various stimulation processes.

Upon completion of the acid stimulation treatment of the lowermost zone or target, a slightly larger ball is dropped or pumped down the work string into the assembly where it passes through the upper modules and lands on the ball seat of module 15. Pressure is again increased inside the work string to shift the shifting sleeve from the closed position to the open position so that the jet nozzles of module 15 are exposed. Acid is then pumped through the jet nozzle of module 15 to acidize and erode the wellbore adjacent the module. The ball in module 15 prevents acid from flowing down to module 20.

The remainder of the zones of interest or targets are selectively acidized or treated by dropping or pumping successively larger balls into the assembly and repeating the above-described sequence. Upon completion of the stimulation treatment of all zones, the packer can be released from the production casing and the assembly can be pulled out of the well. However as discussed above, the dimension of the fracturing string limits the number of balls that may be dropped into the string. For example, the fracturing string may be limited to twenty four, or possibly even less, production zones that may be fractured for a single string.

The assembly allows an operator to selectively stimulate a relatively low number of producing zones, such as twenty or twenty four, in a wellbore in a single trip. By dropping successively larger actuating balls, an operator can shift a sleeve in successive modules and then squeeze and jet a desired volume of hydrochloric acid, other type of acid, or other treating fluid into the producing zones of the interest. By diverting the acid through the nozzles in the modules, the acid will impact the wellbore at high velocity under squeezed pressures. The kinetic energy of the acid will erode away the wellbore and thereby create a cavern in addition to penetrating the formation rock with the acid. The acidizing and wellbore erosion will enhance the ability of oil or other hydrocarbons to flow into the wellbore at these locations. The wellbore is thus treated both mechanically and chemically by dissolving materials that are plugging the pores of the formation rock, such as fines, paraffins, or clays or other materials that have reduced the porosity and/or permeability of the formation. By jetting a large cavern at the face of the wellbore, the resistance to the flow of oil or gas into the wellbore is reduced.

Although not limited to such application, the present invention is well suited for stimulating a calcareous formation with, for example, hydrochloric acid.

Figure 4:
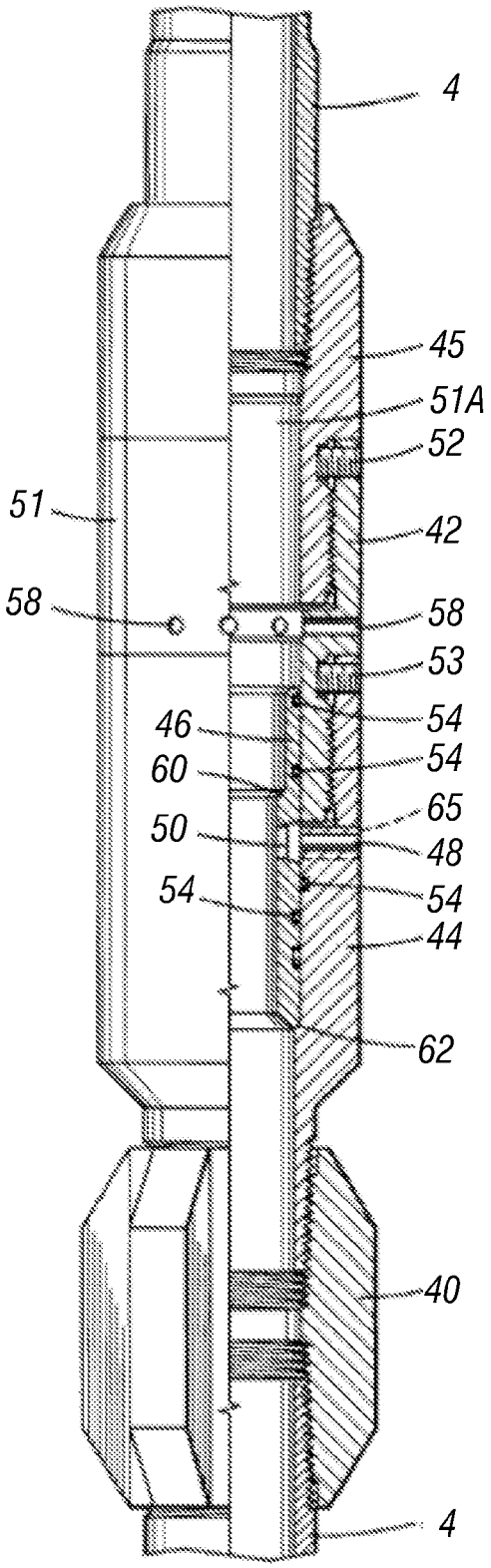
FIG. 4 (Prior Art)
FIG. 4 shows a partial cutaway of an alternative embodiment of a module for use in an assembly for selectively stimulating a plurality of producing zones in a wellbore.

An alternative embodiment of a module for use in an assembly of the present invention is shown in FIG. 4. The module has a generally tubular shaped housing 51 comprising top sub 45, nozzle body 42, and bottom sub 44. Central passageway 51*a* extends longitudinally through the module. The upper portion of top sub 45 includes internal threads for connecting the module to upper tailpipe 4. Top sub 45 includes external threads on its lower end for connecting top sub 45 to nozzle body 42. Nozzle body 42 includes internal threads for mating with the external threads of top sub 45. Nozzle body 42 also includes external threads on its lowermost end for mating with internal threads on the upper end of bottom sub 44. Bottom sub 44 includes threads on its lowermost end for mating with internal threads on centralizing coupling 40. Centralizing coupling 40 is threadedly attached to the lower tailpipe 4.

Nozzle body 42 may be further secured to top sub 45 by one or more set screws 52. Similarly, nozzle body 42 may be further secured to bottom sub 44 by one or more set screws 53. Nozzle body 42 has a plurality of radially extending nozzle ports 58 drilled therethrough. The nozzle ports 58 extend about the circumference of nozzle body 42. The number and size of nozzle ports 58 may vary from module to module depending on the fluid flow characteristics required for the stimulation treatment at each desired producing zone. By way of example, nozzle body 42 may include eight nozzle ports ranging in diameter from 1/16 to 3/16 of an inch spaced approximately 45 degrees apart about the circumference of the nozzle body.

Shifting sleeve 46 is adapted for longitudinal movement along the inner wall of housing 51. Sleeve 46 includes one or more radially extending flow ports 50. The annular space between shifting sleeve 46 and the inner walls of top sub 45, nozzle body 42, and bottom sub 44 is sealed by a plurality of seals 54. Sleeve 46 is shifted from a closed position straddling nozzle ports 58 to the stimulating position shown in FIG. 4 by landing an appropriately sized shifting ball (not shown) on ball seat 60. Sleeve 46 is initially held in the closed position by one or more shear screws 48. After a shifting ball lands on seat 60 (not shown), the tubular pressure is increased until shear screws 48 shear allowing shifting sleeve 46 to be longitudinally moved downward to the stimulating position. Shoulder 62 may be provided to stop the downward movement of sleeve 46. In the stimulating position, flow ports 50 are aligned with a corresponding number of flow ports 65 in bottom sub 44, as shown by the dotted line. Flow ports 65 extend radially through the bottom sub and are spaced, for example, 45 degrees apart from shear screws 48 along the same plane.

An operator can change the size and number of nozzle ports in a module by using interchangeable nozzle bodies 42. The interchangeable nozzle bodies provide an operator an alternative to the use of interchangeable jet nozzles as described in the embodiment of FIG. 2. Nozzle body 42 may be made of a variety of steel alloys commonly used in the oil industry or may be made of high chromium materials or heat treated metals to increase the erosion resistance of nozzle ports 58. The remaining portions of the module, including top sub 45, bottom sub 44 and shifting sleeve 46, can be made of a variety of steel alloys commonly used in the oil field.

Although different embodiments of a module are illustrated in FIGS. 2 and 4, the method of selectively actuating the different modules of an assembly can be more readily understood by comparing the respective ball seats of the modules in these figures. As can be seen, the internal diameter of ball seat 60 in the module of FIG. 4 is substantially larger than the internal diameter of ball seat 35 in the module of FIG. 2. Thus, the actuating ball for seat 35 will easily pass through ball seat 60 and continue through the assembly until it lands on seat 35 of the lower module. Therefore, an operator can selectively actuate the modules in the assembly from the bottom up by dropping or displacing progressively larger actuating balls into the assembly, thereby allowing the operator to selectively stimulate a plurality of producing zones in a single trip.

Although the embodiments described above are actuated by using successively larger balls, it should be readily understood that the modules can be actuated by other means. For example, the shifting sleeves of the modules could be easily adapted to be actuated by dropping or pumping down the assembly appropriately sized darts, bars, plugs, or the like. Alternatively, each shiftable sleeve may include a selective profile, such as an Otis "X" or Baker "R" style profile, and the actuating means for a particular sleeve would include a locking mechanism with a mating profile. In such an embodiment, the actuating means would pass through all modules except the module that had a shifting sleeve with a mating profile.

Figure 5:
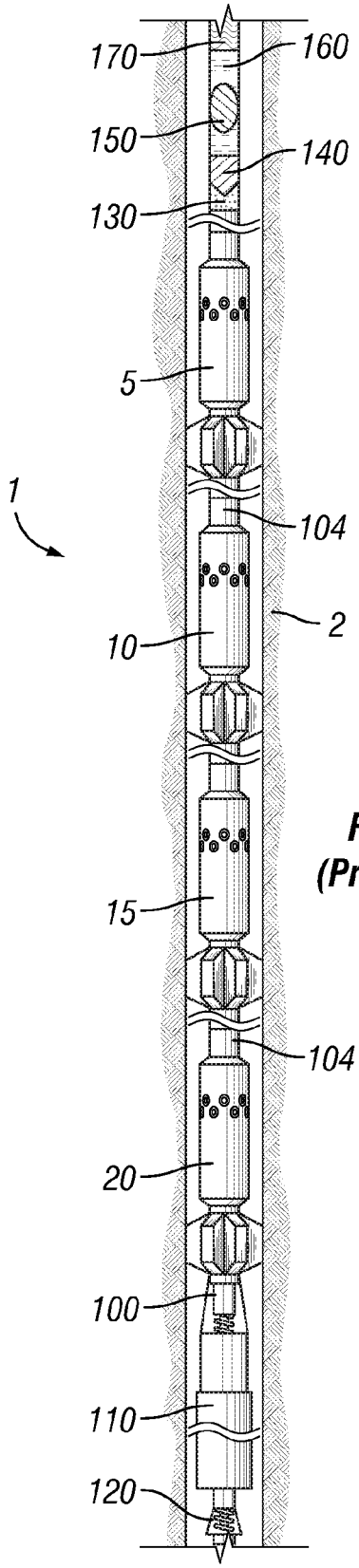
FIG. 5 (Prior Art)
FIG. 5 shows a partial cutaway of a system that may be cemented in a wellbore and used for selectively stimulating a plurality of producing zones.

FIG. 5 shows the process of cementing an assembly 1 into the open wellbore 2. Cement 130 is pumped down a string 104 through the plurality of modules 5, 10, 15, and 20 attached to the string 104. A float collar 100 is connected to the centralizing coupling connected to the lowermost module 20. Alternatively, the float collar 100 may be connected directly to the lowermost module 20 or a portion of the string 104 located below the lowermost module 20. The cement 130 is pumped through a shoe joint 110 and float shoe 120 connected to the float collar 100. The cement 130 exits the float shoe 120 and fills the annulus between the string 104 and the open wellbore 2 to cement the string 104 within the open wellbore 2.

A wiper plug 140 is pumped down the string 104 above the trailing end of the cement 130 being pumped down the string 104. The wiper plug 140 wipes the string 104 removing cement 130 from the interior of the string 104 and from the interior of the modules 5, 10, 15, and 20. The wiper plug 140 is pumped to the end of the string 104 removing the cement 130 within the string 104 until it reaches the float shoe 120. Alternatively, the wiper plug 140 may be landed in the float collar 100. At least one wiper ball 150 may also be pumped down the string 104 to remove any residual cement 130 remaining in the string 104 or in any of the modules 5, 10, 15, and 20. Multiple wiper balls 150 may be pumped down the string 104 in an effort to wipe the string 104 and modules 5, 10, 15, and 20 of any residual cement 130. The wiper ball 150 may be comprised of natural rubber or other materials that allow the wiper ball to wipe the string 104. Further, multiple wiper balls 150 having differing outer diameters may be used to ensure the removal of residual cement 130 as would be appreciated by one of ordinary skill in the art having the benefit of this disclosure. The wiper ball 150 used to wipe the string 104 and the modules 5, 10, 15, and 20 may be, for example, a drill-pipe wiper ball comprised of natural caoutchouc rubber commercially offered by Halliburton.

An acid solution 170, such as acetic acid, may then be pumped down the string 104 to displace the cement 130 and the wiper plug 140 and wiper ball(s) 150. The acid solution 170 may prevent any residual cement 130 from setting or curing within the string 104 and the modules 5, 10, 15, and 20. Further, the acid solution 170 may break up or fracture the cement 130 on the exterior of the string 104 at the module locations when the stimulation process, as discussed above, begins. The wiper ball 150 may be pumped down the string 104 in a spacer fluid 160 between the cement 130 and the acid solution 170 to help protect the wiper ball 150 from being damaged by the acid solution 170. The acid solution 170 may be pumped down the string 104 until the central passageway of each module contains the acid solution 170. After the acid solution 170 has been pumped into and retained in the string 104, the operator will allow the cement 130 on the exterior of the string 104 to cure and cement the string 104 within the open wellbore 2. The presence of the acid solution 170 within the string 104 during the curing process may ensure that the slidable sleeves within the modules function properly when actuated.

Figure 6:
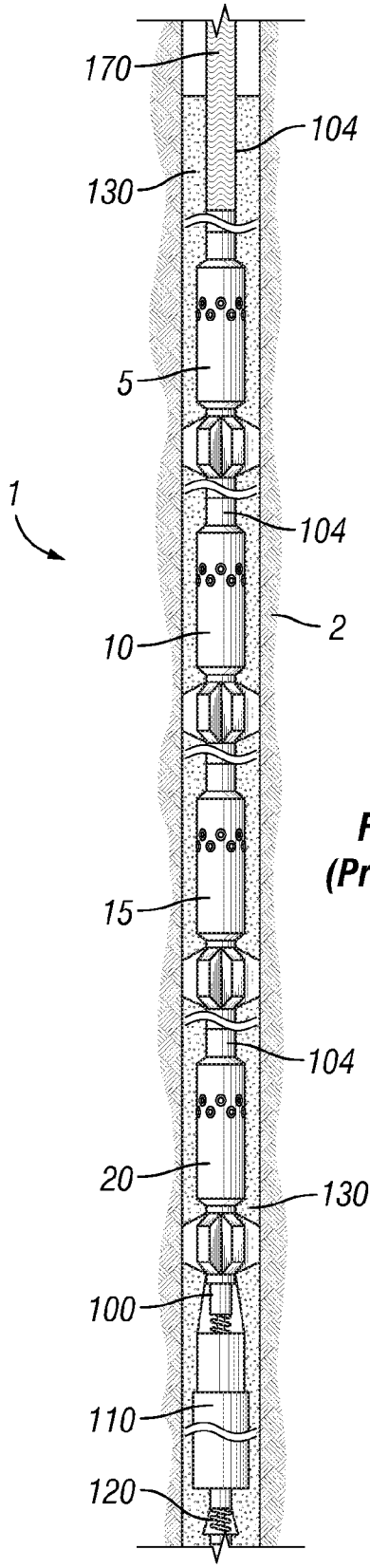
FIG. 6 (Prior Art)
FIG. 6 illustrates a partial cutaway of a system for selectively stimulating a plurality of producing zones, the system being cemented within the wellbore.

FIG. 6 illustrates the assembly 1 cemented in the open wellbore 2. At this point, fluid may be pumped within the string 104 until the hydraulic pressure moves the sliding sleeve of the lowermost module 5 to its open position. After the sleeve is in its open position, the acid solution 170 will exit through the radial passageways and begin to break down and remove the cement 130 that has formed adjacent to the module. The fluid will then fracture the formation once it has removed the cement at the zone of interest. The next module will be actuated as discussed above and the process will be repeated until each of the zones of interest has been stimulated.

Figure 7:
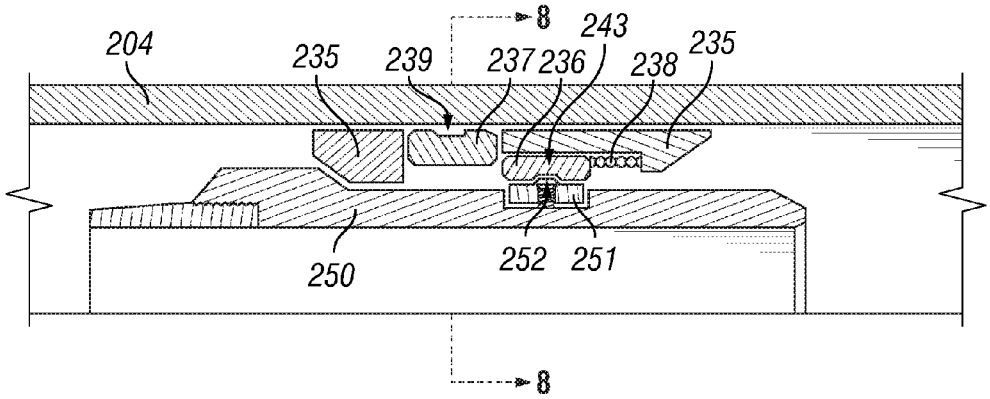
FIG. 7 shows a partial cross-section view of one embodiment of a ball seat assembly connected to a running tool within a liner of a fracturing string.

FIG. 7 shows a ball seat assembly connected to a running tool 250 being run into a work, or fracturing, string 104 (shown in FIG. 5). The ball seat assembly comprises a ball seat 235, a key 237, a lock sleeve 236, and a spring 238. The lock sleeve 236 includes a profile 243 that is adapted to engage a corresponding profile 252 on the exterior of a lock dog 251 connected to the running tool 250. The lock dog 251 selectively retains the lock sleeve 236 in an unlocked position, as shown in FIG. 7. In the unlocked position, the spring 238 is in a compressed state biasing the lock sleeve 236 towards a locked position (shown in FIG. 9), discussed in more detail below. A spring 254 (shown in FIG. 8), such as a leaf spring, biases the key 237 towards and outward or expanded position. As the running tool 250 and connected ball seat assembly are run into the string, the liner (or tubing) 204 retains the key 237 in an inward or retracted position.

The running tool 250 and connected ball seat assembly with be run into the string to the appropriate location along the string onto which the ball seat assembly will be selectively installed. The work string has already been inserted into the well with a plurality housing portions or modules that include fracturing sleeves, which permit communication out of the string to treat the well formation, as discussed herein. The housing portions have been appropriately spaced along string to be located adjacent the zones that the operator desires to stimulate and/or fracture. One advantage of the tubing run ball seat assembly of the present disclosure is that a large number of zones may be stimulated during a single trip into the well with the string. Prior systems were limited to stimulating between ten (10) and twenty (20) zones, but the removable ball seat assembly of the present disclosure permits the stimulation of more than twenty (20) zones and realistically even sixty (60) or eighty (80) zones could be stimulated with a single trip of the string into the well. This may result in a significant savings to the well operator during the completion process of a wellbore.

Figure 8:
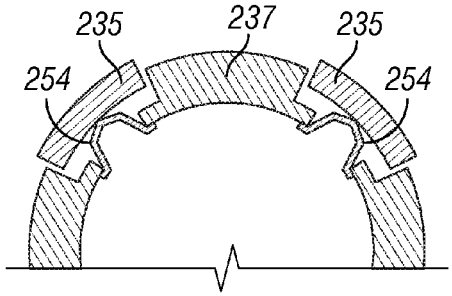
FIG. 8 shows a partial cross-section end view of the ball seat assembly of FIG. 7.
Figure 9:
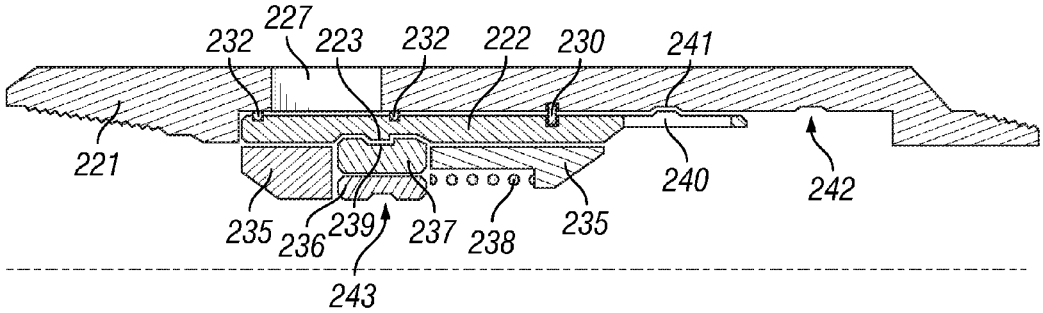
FIG. 9 shows a cross-section view of one embodiment of a ball seat assembly connected to a housing that may be connected to a fracturing string, the housing including a fracture sleeve shown in a closed position.

FIG. 8 shows a partial cross-section end view of a portion of the ball seat assembly. Leaf spring 254 is position to bias the key 237 in an outward position, which permits the selective installation of the ball seat assembly onto a housing portion 221 on the work string. To install the ball seat assembly, the running tool 250 is move down the string past the specified housing 221. The running tool 250 is then pulled up the string and as the ball seat assembly moves past housing 221 a profile 239 on the exterior of key 237 engages a corresponding profile 223 of the fracturing sleeve 222 that is connected to the housing 221. As the running tool 250 continues to move up the string, the ball seat assembly is retained in place by the mating interface between the key 237 and the sleeve 222 separating the ball seat assembly from the running tool 250. The spring 238 moves the lock sleeve 236 to a locked position as shown in FIG. 9, which selectively retains the key 237 in an engaged position with the sleeve 222. The running tool 250 may then be removed from the work string. The running tool 250 may then be used to run into the string to install another ball seat assembly onto a housing portion 221 located at the adjacent production zone.

Figure 10:
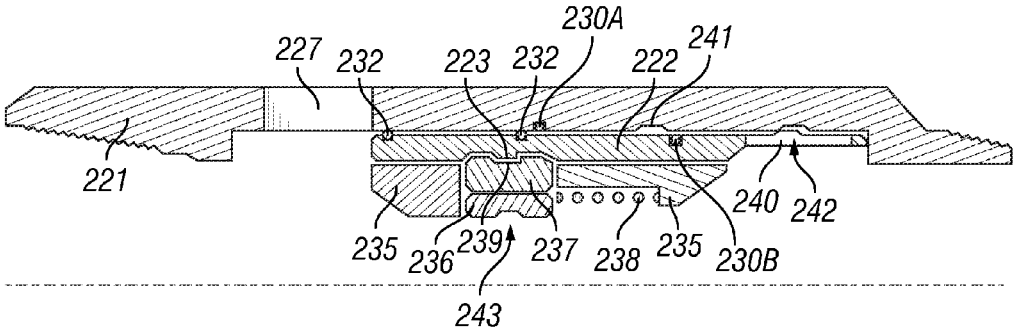
FIG. 10 shows a cross-section view cutaway the ball seat assembly of FIG. 10 with the fracture sleeve of the housing in an open position.

FIG. 9 shows the ball seat assembly selectively installed on a housing portion 221 of a work string. The housing 221 includes a port 227, also referred to herein as a fracture port, which permits communication between the inner bore of the work string and the wellbore formation. Fluid may be pumped down the string and out of the port 227 to stimulate and/or fracture the wellbore formation adjacent the port 227. The housing 221 includes a sleeve 222 that may be moved between a closed position shown in FIG. 9 and an open position shown in FIG. 10. In the closed position, seals 232 between the sleeve 222 and the housing 221 prevent fluid communication through the port. The sleeve 222 includes a collet 240 that is adapted to provide a portion of the collet 240 that selectively engages a first recess 241 in the housing 221 when the sleeve 222 is located in the closed position. When the sleeve 222 is moved to the open position, as shown in FIG. 10, the portion of the collet 240 engages a second recess 242 in the housing 221 to selectively retain the sleeve 222 in the open position. The geometry of the recesses 241, 242 and collet finger 240 are adapted to permit the sleeve 222 to be released and moved to the open position upon the application of a pressure differential or moved to the closed position upon engagement with a shifting tool, as discussed in detail herein.

The string is positioned into the wellbore with a plurality of housings 221 having selectively movable sleeves 222 that may be actuated to permit fluid communication from the work string to the wellbore formation. As discussed above, the housings 221 will be spaced apart along the string so that each housing 221 is positioned adjacent production zones that will later be treated during the completion process. The sleeve 222 may be initially held in the closed position preventing fluid communication through the port 227 by a shearable device 230, such as a shear pin. The shearable device 230 may be adapted to shear releasing the sleeve 222 from the closed position upon the application of a predetermined pressure differential. The pressure differential is created by inserting a device, such as a ball or dart, into the string and pumping it down the string until it is seated within the ball seat 235. The ball seat 235 is adapted to retain a particular sized ball 37 (shown in FIG. 3), as discussed above. Once seated, the ball, or other inserted device, prevents fluid flow through the string pass the ball seat 235. The operator may then pump fluid down the string to increase the pressure within the string until obtaining the predetermined pressure differential required to shear the shearable device 230 releasing sleeve 222 from the closed position shown in FIG. 9. The operator will recognize that the sleeve 222 has opened by the increase pressure within the string followed by a pressure drop, which indicates that the sleeve 222 has opened allowing fluid communication outside of the string.

The selectively attachable ball seat assembly of the present disclosure enables a large number of production zones to be stimulated with a single insertion of a work string into a wellbore. The string may be inserted into the wellbore with a plurality, for example sixty (60), of housing portions 221 located along the string being positioned at production zones in the well formation, as discussed above. The operator may then individually run in and set of set of ten (10) ball seat assemblies on the lowest ten (10) housing portions 221. The operator may then increase fluid within the string to open a hydro port located at the toe of the string allowed the lowest zone to be treated and/or fractured. The operator may then proceed to insert the smallest ball which will travel down the string and seat on the ball seat 235 of the lowest ball seat assembly. The pressure may then be increased within the string to open the fracture sleeve 222 and stimulate and/or fracture the adjacent zone. The next smallest ball may then be inserted into the string and pumped down until seated upon the ball seat 235 of the next lowest ball seat assembly. Again the pressure will be increased within the string until the shearable device 230 shears releasing the sleeve 222, which will move to the open position due to the increased pressure differential. Then the adjacent production zone may be stimulated and/or fractured. Upon shearing of the shearable device 230, a portion 230A may remain in the housing 221 and a portion 230B may remain in the sleeve 222 as shown in FIG. 10. The process is repeated until all ten (10) zones adjacent the ten (10) ball assemblies are stimulated and/or fractured.

After all ten (10) zones have been fractured, a new set of ten (10) ball seat assemblies may be individually ran into the string using a running tool 250. The ball seat assemblies may be selectively installed onto the ten (10) housing sections 221 that are next moving uphole in the string from the previous ten (10) zones that were fractured. The ten ball seat assemblies may use the same size of balls that were previously used to fracture the lower production zones. This process may be repeated until all production zones along the string have been stimulated and/or fractured. The use of ten (10) ball seat assemblies at one time is for illustrative purposes only. The total number of production zones and the number of ball seat assemblies used as a set may be varied as would be appreciated by one of ordinary skill in the art having the benefit of this disclosure.

Figure 11:
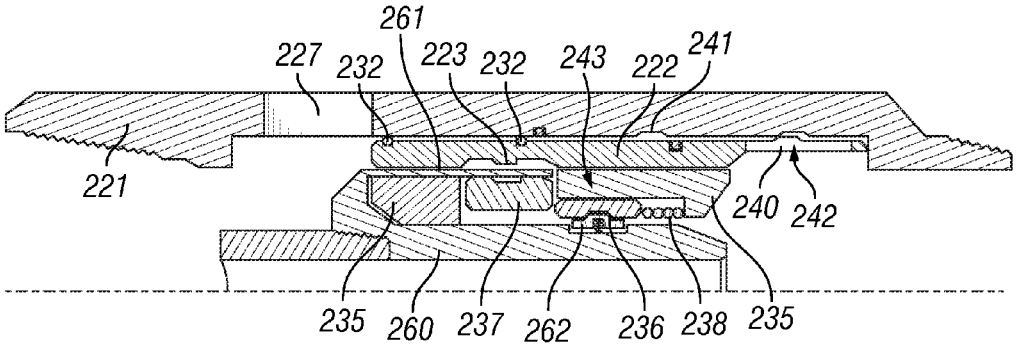
FIG. 11 shows a cross-section view of one embodiment of a retrieval tool that may be used to retrieve a ball seat assembly previously installed within a fracturing string.

After all production zones have been stimulated, the ball seat assemblies may all be retrieved individually from the work string using a retrieval tool. FIG. 11 shows one embodiment of a retrieval tool 260 that may be used to remove a ball seat assembly from the work string. The retrieval tool 260 includes a key 262 that is adapted to engage the exterior profile 243 on the lock sleeve 236 of the ball seat assembly. Once engaged, downward movement of the retrieval tool 260 moves the lock sleeve 236 to the unlocked position compressing the biasing spring 238. The downward movement of the retrieval tool 260 also disengages the key 237 of the ball seat assembly from engagement with the profile 223 of the sleeve 222 releasing the ball seat assembly from the housing 221. The retrieval tool 260 includes a shroud 261 that traps the key 237 in the retracted position preventing the key 237 from re-engaging the sleeve profile 223 as the retrieval tool 260 and ball seat assembly are moved up the string.

After removal of the ball seat assemblies, a shifting tool may be used to engage the profile 223 on the sleeve 222 to move the sleeve 222 back to the closed position, if desired. The profile 233 on the sleeve 222 may be adapted to be actuated by a conventional shifting tool, such as an Otis shifting tool. The ball seat assemblies do not have to be removed after all of the production zones have been fractured. For example, after fracturing the lowest set of production zones the ball seat assemblies could be removed from the string before the next set of ball seat assemblies is ran into the string, if desired. Further, the sleeves 222 of the lowest set of production zones could be closed using a shifting tool before moving on the fracturing the next set of production zones. Preferably, the ball seat assemblies would be made of a material, such as steel, that would permit the assembly to be reused within a well, if desired. Prior ball seats have been typically made from cast iron to aid in the ability to mill out the ball seat after the fracturing process.

The ball seat assembly and methods of the present disclosure provide great flexibility in the stimulation of multiple zones of a wellbore with a single trip of a work string. For example, the running of ball seat assemblies into the well after the insertion of the work string allows an operator to skip over a production zone, if desired. Further, a larger number of production zones may be stimulated for a single trip of a work string into the wellbore. The tubing run ball seat assembly also eliminates the need to also stimulate the lowest production zone and move upwards along the string. Instead, an operator could stimulate the production zones any practically any order after opening the hydro port and the toe of the string. This is because the system of the present disclosure provides for the selective closure of previously opened sleeve as well as removable ball assemblies. Removing the ball assemblies eliminates the need to mill out the assemblies. The system and methods of the present disclosure provide for improved stimulation of production zones using a single trip of a work string.

Although various embodiments have been shown and described, the disclosure is not so limited and will be understood to include all such modifications and variations as would be apparent to one skilled in the art.

What is claimed is:

1. An apparatus for selectively stimulating a formation within in a wellbore, the apparatus comprising:

a housing connected to a fracturing string, the housing having a fracture port permitting fluid communication between an inner bore of the housing and an exterior of the housing, the housing including a fracture sleeve that is movable between an open position and a closed position, wherein the closed position prevents fluid communication between the inner bore and the exterior of the housing; and a ball seat assembly that is adapted to selectively engage the housing, the ball seat assembly comprising:

a ball seat adapted to sealingly engage a ball having a predetermined diameter;

a key connected to the ball seat, the key being adapted to selectively mate with a profile on the fracture sleeve;

a lock sleeve connected to the ball seat, the lock sleeve being movable from an initial unlocked position to a locked position, the lock sleeve being biased to the locked position, in the locked position the lock sleeve being adapted to selectively retain the key in a mated position with the profile on the fracture sleeve.

2. The apparatus of claim 1, wherein the ball seat assembly is adapted to be installed onto a housing of a fracturing string already positioned within a wellbore.

3. The apparatus of claim 1 further comprising a spring, wherein the spring biases the lock sleeve to the locked position.

4. The apparatus of claim 1 further comprising a collet finger, the collet finger adapted to selectively engage a first recess in the housing when the fracture sleeve is in the closed position and engage a second recess in the housing when the fracture sleeve is in the open position.

5. The apparatus of claim 1 further comprising a shearable device that selectively retains the fracture sleeve in the closed position, the shearable device adapted to shear and release the fracture sleeve upon the application of a predetermined pressure differential.

6. The apparatus of claim 1 further comprising a leaf spring connected to the ball seat, the leaf spring adapted to move the key to an expanded position, wherein the key is in the expanded position when engaged with the profile on the fracture sleeve.

7. The apparatus of claim 1, wherein the lock sleeve includes an exterior profile adapted to engage a profile on a running tool.

8. The apparatus of claim 7, wherein the exterior profile of the lock sleeve is adapted to engage a lock dog on the running tool.

9. The apparatus of claim 7, wherein the exterior profile of the lock sleeve is adapted to engage a profile on a retrieval tool.

10. The apparatus of claim 9, wherein the running tool is adapted to position the ball seat assembly into a wellbore to selectively engage the housing of the fracture string when the fracture sleeve is in the closed position.

11. The apparatus of claim 10, wherein the retrieval tool is adapted to release the ball seat assembly from the housing of the fracture string when the fracture sleeve is in the open position.

12. A method of selectively fracturing multiple zones within a wellbore with a single trip into the wellbore with a fracture string, the method comprising:

running at least a first ball seat assembly into a wellbore;

selectively connecting the first ball seat assembly onto a first housing on the fracture string within the wellbore, wherein the fracture string is positioned in the wellbore prior to running the first ball seat assembly into the wellbore;

running at least a second ball seat assembly into the wellbore after running the first ball seat assembly;

selectively connecting the second ball seat assembly to a second housing on the fracture string;

applying pressure to the fracturing string to open a hydro port sub on the fracture string;

inserting a first ball in the fracture string, the first ball adapted to seat on the first ball seat and prevent fluid flow within the fracture string past the first ball seat;

pumping fluid down the fracture string to create a pressure differential, the pressure differential moving a sleeve within the first housing opening a first fracture port;

fracturing a formation adjacent the first fracture port;

inserting a second ball in the fracture string, the second ball adapted to seat on the second ball seat and prevent fluid flow within the fracture string past the second ball seat;

pumping fluid down the fracture string to create a pressure differential, the pressure differential moving a sleeve within the second housing opening a second fracture port; and fracturing a formation adjacent to the second fracture port.

13. The method of claim 12 further comprising running a third ball seat assembly into the wellbore and selectively connecting the third ball seat assembly onto a third housing on the fracture string within the wellbore, wherein the third ball seat assembly is run into the wellbore after fracture the formation adjacent to the second fracture port.

14. The method of claim 13 further comprising inserting a third ball in the fracture string, the third ball adapted to seat on the third ball seat and prevent fluid flow within the fracture string past the third ball seat, wherein the third ball has a diameter that is same as a diameter of the first ball.

15. The method of claim 14 further comprising pumping fluid down the fracture string to create a pressure differential, the pressure differential moving a sleeve within the third housing opening a third fracture port and fracturing a formation adjacent to the third fracture port.

16. The method of claim 15 further comprising removing the first ball seat assembly, the second ball seat assembly, and the third ball seat assembly from the wellbore.

17. The method of claim 16 further comprising moving at least one of the sleeves to close one of the fracture ports.

18. The method of claim 12, wherein the first ball seat assembly is run into the wellbore selectively connected to a running tool.

19. The method of claim 18, wherein selectively connecting the first ball seat assembly onto the first housing comprises moving the running tool downhole past the first housing and pulling the running tool uphole past the first housing engaging a first profile on the first ball seat assembly with a profile on the sleeve of the housing to selectively retain the first ball seat assembly to the sleeve of the housing.

20. A method for completing a hydrocarbon producing wellhole, comprising:

running a ball seat assembly on a running tool into a work string within a wellbore, wherein the work string is positioned in the wellbore prior to running the ball seat assembly into the work string;

selectively connecting the ball seat assembly to a portion of the work string, the portion having a port and a sleeve movable between a closed position preventing fluid communication through the port and an open position allowing fluid communication through the port;

inserting a first ball into the work string, the first ball adapted to seat on the ball seat assembly preventing fluid flow through the work string past the ball seat;

applying a pressure differential within the work string, wherein upon the application of a predetermined pressure differential the sleeve moves to the open position; and treating a well formation through the open port.

21. The method of claim 20 further comprising releasing the ball seat assembly from the portion of the work string and retrieving the ball seat assembly from the work string.

22. The method of claim 21, wherein a retrieving tool releases and retrieves the ball seat assembly.

23. The method of claim 21 further comprising moving the sleeve to a closed position.

24. The method of claim 23, wherein a shifting tool is used to move the sleeve to the closed position.

25. The method of claim 20 further comprising running a second ball seat assembly into the work string and selectively connecting the second ball seat assembly to a second portion of the work string, the second portion having a second port and a second sleeve movable between a closed position preventing fluid communication through the second port and an open position allowing fluid communication through the second port.

26. The method of claim 25 further comprising inserting a second ball into the work string, the second ball adapted to seat on the second ball seat assembly preventing fluid flow through the work string past the second ball seat, applying a pressure differential within the work string to move the second sleeve to the open position, and treating a well formation through the open second port.

27. The method of claim 26, wherein the first ball and the second ball are the same size.

28. A system for treating multiple zones of a wellbore with a single trip of a work string, the system comprising:

a work string positioned within the wellbore;

a first plurality of housings located along the work string, each housing of the first plurality of housings having a port and a sleeve movable to open and close the port;

a second plurality of housings located along the work string, each housing of the second plurality of housings having a port and a sleeve movable to open and close the port;

a first plurality of ball seat assemblies adapted to be run into the work string already positioned in the wellbore, each of the first plurality of ball seat assemblies adapted to selectively mate with a housing of the first plurality of housing;

a first plurality of balls each being a different size adapted to be inserted individually into the work string, each ball of the first plurality of balls adapted to be retained by a corresponding ball seat assembly within the first plurality of ball seat assemblies, wherein an application of a pressure differential to the work string moves the sleeve and opens the port of each housing of the first plurality of housings;

a second plurality of ball seat assemblies adapted to be run into the work string already positioned in the wellbore, each of the second plurality of ball seat assemblies adapted to selectively mate with a housing of the second plurality of housings; and a second plurality of balls each being a different size adapted to be inserted individually into the work string, each ball of the second plurality of balls adapted to be retained by a corresponding ball seat assembly within the second plurality of ball seat assemblies, wherein an application of a pressure differential to the work string moves the sleeve and opens the port of each housing of the second plurality of housings.

29. The system of claim 28, wherein the different sizes of the first plurality of balls is identical to the different sizes of the second plurality of balls.

30. The system of claim 28 further comprising a third plurality of housings located along the work string each having a port and a sleeve movable to open and close the port, a third plurality of ball seat assemblies adapted to be run into the work string already positioned in the wellbore each adapted to selectively mate with a housing of the third plurality of housing, and a third plurality of balls each being a different size adapted to be inserted individually into the work string, each ball adapted to be retained by a corresponding ball seat assembly within the third plurality of ball seat assemblies, wherein an application of a pressure differential to the work string moves the sleeve and opens the port of each housing of the third plurality of housings.

31. The system of claim 30, wherein the different sizes of the first plurality of balls is identical to the different sizes of the third plurality of balls.

* * * * *